United States Patent [19]

Reinke

[11] Patent Number: 4,771,754

[45] Date of Patent: Sep. 20, 1988

[54] PNEUMATIC DIRECT CYLINDER FUEL INJECTION SYSTEM

[75] Inventor: Paul E. Reinke, Rochester Hills, Mich.

[73] Assignee: General Motors Corporation, Detroit, Mich.

[21] Appl. No.: 116,919

[22] Filed: Nov. 5, 1987

Related U.S. Application Data

[63] Continuation of Ser. No. 45,571, May 4, 1987, abandoned.

[51] Int. Cl.[4] ..... F02M 23/12

[52] U.S. Cl. ..... 123/533; 123/532

[58] Field of Search ..... 123/531, 533, 534, 535, 123/478; 239/533.2, 533.4, 533.12

[56] References Cited

U.S. PATENT DOCUMENTS

| | | | |
|---|---|---|---|
| 1,562,539 | 11/1925 | Cole | 123/531 X |
| 1,589,982 | 6/1926 | Müller | 123/531 |
| 1,631,615 | 6/1927 | Blanding | 123/531 |
| 1,871,115 | 8/1932 | Cowardin et al. | 123/533 |
| 2,146,265 | 2/1939 | Moore, Jr. | 123/531 X |
| 4,381,077 | 4/1983 | Tsumura et al. | 123/531 X |
| 4,394,963 | 7/1983 | Iwata | 123/531 X |
| 4,627,390 | 12/1986 | Antoine | 123/531 X |
| 4,628,888 | 12/1986 | Duret | 123/531 |

FOREIGN PATENT DOCUMENTS

| | | |
|---|---|---|
| WO85/00854 | 2/1985 | PCT Int'l Appl. . |
| WO86/00960 | 2/1986 | PCT INt'l Appl. . |
| WO87/00584 | 1/1987 | PCT Int'l Appl. . |

*Primary Examiner*—Willis R. Wolfe

*Attorney, Agent, or Firm*—Arthur N. Krein

[57] ABSTRACT

A pneumatic direct cylinder fuel injection system for an internal combustion engine includes a pneumatic injector for each cylinder so as to supply a pressurized air/fuel charge to an associate stratified charge chamber forming a part of the associate combustion chamber preferably during the compression stroke of the associate piston, the quantity of fuel being supplied by an electromagnetic fuel injector. The pressurized air for the system can be supplied by an electrical or engine driven air pump or preferably the engine itself can be used as an air compressor with each cylinder having an air source control valve operatively associated therewith to control the flow of pressurized air during the compression stroke of the piston in its associate cylinder.

4 Claims, 3 Drawing Sheets

PNEUMATIC DIRECT CYLINDER FUEL INJECTION SYSTEM

This is a continuation of U.S. patent application Ser. No. 045,571 filed May 4, 1987, now abandoned.

FIELD OF THE INVENTION

This invention relates to a fuel injection system for internal combustion engines and, in particular, to a pneumatic direct cylinder fuel injection system.

DESCRIPTION OF THE PRIOR ART

The desirability of air assisted injection of fuel into the combustion chamber of an internal combustion engine in a manner so as to reduce or eliminate the wetting of the walls of a combustion chamber with liquid fuel whereby to increase fuel efficiency and reduce exhaust emission has long been recognized.

For this purpose there has been proposed a large variety of differing fuel injection systems, which in the more simple forms include conventional throttle body injection or port injection systems. In more complex forms of such air assisted injection systems they can be of the type disclosed in copending U.S. patent application Ser. No. 900,093, entitled "Air-Assist Fuel Injection Nozzle", filed Aug. 25, 1986 in the name of Edward D. Klomp and assigned to a common assignee, now U.S. Pat. No. 4,693,420, or as disclosed in U.S. Pat. No. 2,984,230 issued May 16, 1961 to Clessie L. Cummins. Of course the first two described systems cannot be actually classified as direct cylinder fuel injection systems.

SUMMARY OF THE INVENTION

The present invention relates to a pneumatic direct cylinder fuel injection system which includes pneumatic injectors, each having a conventional electrical pulse width controlled electromagnetic fuel injector delivering pressurized fuel into an air passage supplied with pressurized air at a predetermined pressure less than that of the fuel pressure and flow through which, into the combustion chamber of an internal combustion engine, is controlled by a poppet valve that can be pressure actuated. The pneumatic injector as used on a four cycle, spark engine is supplied with pressurized air at a predetermined pressure by an electrical or engine driven air pump and, as used on a two cycle spark engine, the engine itself is preferably used as an air compressor with an air source valve metering the air during part of the compression process but which is also operative so as to lock out the high combustion pressures.

It is therefore a primary object of this invention to provide an improved pneumatic direct cylinder fuel injection system for internal combustion engines wherein an electromagnetic fuel injector is arranged so as to deliver fuel, as required, into an air passage supplied with pressurized air and flow through which is controlled by a valve so that an air fuel mixture can be supplied to a stratified charge chamber forming part of an engine combustion chamber, preferably during the compression stroke of an associate piston.

Another object of this invention is to provide an improved pneumatic direct cylinder fuel injection system which includes a plurality of pneumatic injectors each of which is operative with an associate cylinder in a four stroke internal combustion engine, each such pneumatic injector including an electromagnetic fuel injector for delivering fuel to a valve controlled air passage opening into the stratification chamber of an associate cylinder the air passages of an associate pair of pneumatic injectors being connected to a source of pressurized air, such that the electromagnetic fuel injector of one of the pneumatic injectors will be actuated while the piston in the associate cylinder is moving in a compression stroke while the electromagnetic fuel injector of the other pneumatic injector is not actuated so that only pressurized air is delivered while the piston in the other associate cylinder is on an exhaust stroke.

A still further object of the invention is to provide an improved pneumatic direct cylinder fuel injection system which includes a plurality of pneumatic injectors, each of which is associated with an associate cylinder in a two stroke internal combustion engine, each such pneumatic injector including an electromagnetic fuel injector for delivering fuel to a valve controlled air passage opening into a stratification chamber of an associate cylinder, the air passage being operatively connected to a regulated air pressure storage chamber which is supplied with pressurized air, via an air control valve, during a portion of the compression stroke of the respective pistons operating in plural cylinders of the engine.

For a better understanding of the invention as well as other objects and further features thereof, reference is had to the following detailed description of the invention to be read in connection with the accompanying drawings.

DESCRIPTION OF THE EMBODIMENTS

Figure 1:
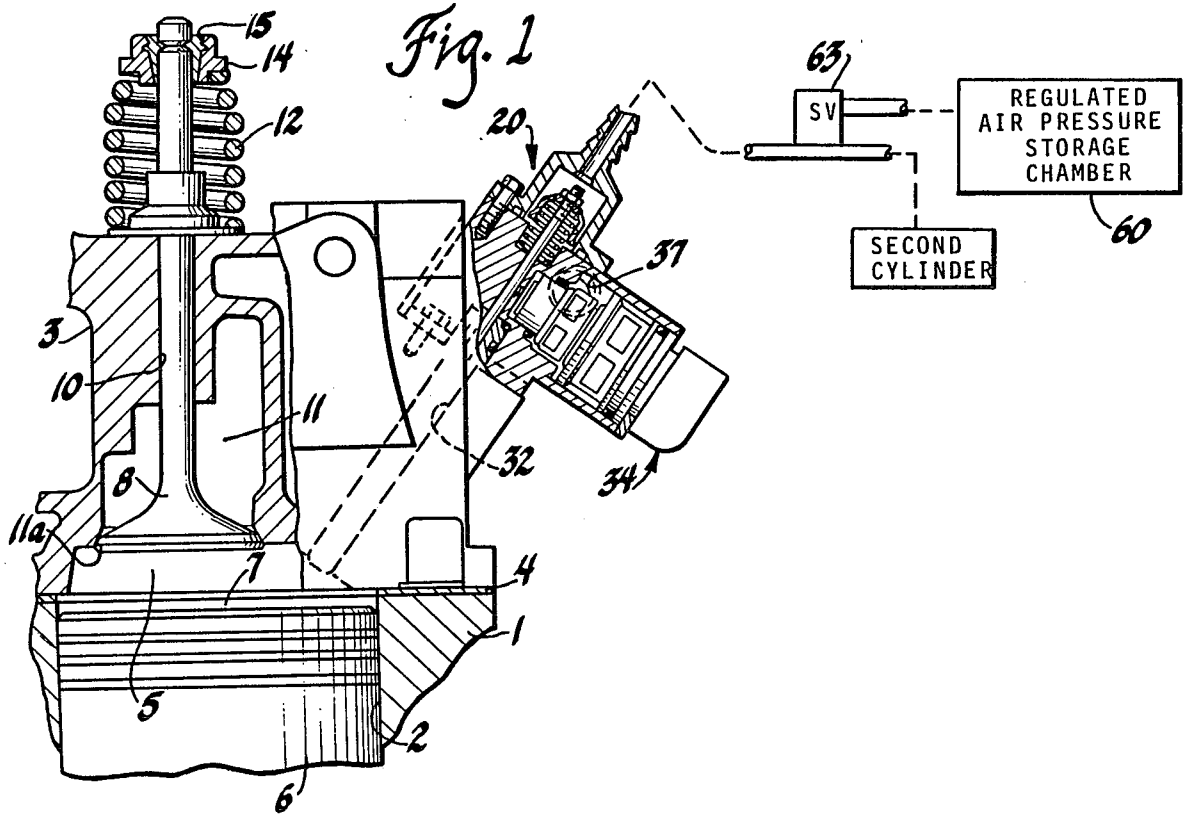
FIG. 1 is a cross-sectional view of a portion of a four-stroke internal combustion engine having a pneumatic direct cylinder fuel injection system in accordance with the invention incorporated therein, with some elements being illustrated schematically.

Referring first to FIG. 1 there is shown a portion of a multiple cylinder, four-stroke, internal combustion engine having an engine block means, which includes an engine block 1 with bores therein defining cylinders 2, only one being shown, and a cylinder head 3 fixed in a conventional manner to the engine block 1, with the usual gasket 4 sandwiched therebetween.

The cylinder head 3 at each cylinder bore 2 location is provided with a recessed cavity defining a stratification chamber or stratified charge chamber 5 which defines with the associate cylinder bore 2 and a piston 6, reciprocably journaled therein, a combustion chamber 7. A pair of poppet valves 8 (intake and exhaust), with only the intake valve 8 being shown, are operatively mounted to control the ingress of air to the associate cylinder and to control the egress of exhaust gases therefrom.

Each intake poppet valve 8 as well as each of the exhaust valves, not shown, is guided for axial reciprocation in a valve stem guide 10 in the cylinder head 3 with the upper stem portion of the poppet valve 8 projecting above the cylinder head 3. In a conventional manner, each poppet valve 8 is normally maintained in a closed position relative to a port, such as the intake port 11*a* at one end of an intake passage 11 for the intake poppet valve 8 shown, by a valve return spring 12 acting against a spring retainer 14 fixed by a split lock 15 to the stem of the intake poppet valve 8 in a conventional manner. Each of the poppet valves 8 is actuated in timed sequence to each other in a conventional manner by a suitable valve train, not shown, since such a valve train does not form a part of the subject invention.

Figure 2:
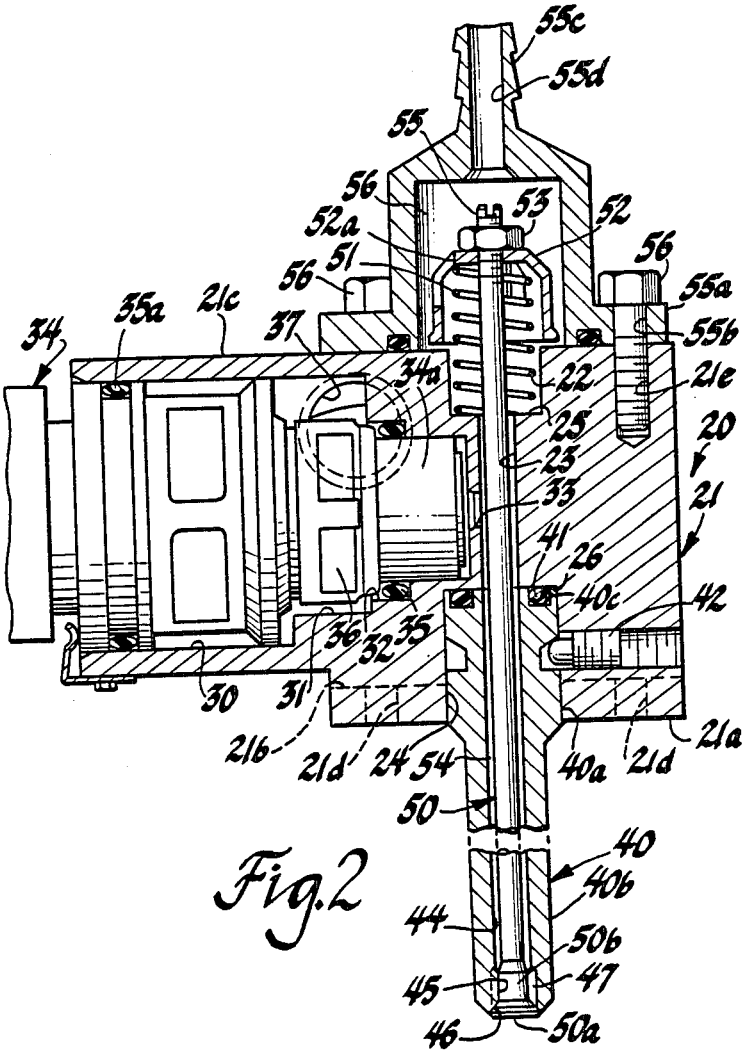
FIG. 2 is a cross-sectional view of the preferred embodiment pneumatic injector, per se, of FIG. 1, with the electromagnetic fuel injector and poppet valve thereof being shown in elevation; and, FIG. 3 is a cross-sectional view of a portion of a two stroke combustion engine having a pneumatic direct cylinder fuel injection system in accordance with the invention, including an air control valve, incorporated therein, with certain elements being illustrated schematically.

Now in accordance with the invention, a pneumatic direct cylinder fuel injection system is operatively associated with the cylinder head 3, the system including a plurality of pneumatic injectors, generally designated 20, which in the preferred embodiment as shown in FIGS. 1 and 2 is operatively positioned to inject a pressurized air/fuel mixture to its associate cylinder. Preferably, as shown in FIG. 1, the pressurized air/fuel mixture is discharged into the stratified charge chamber 5 at a specific time and for a purpose and in a manner to be described hereinafter.

The pneumatic injector 20 as best seen in FIG. 2, includes a main body portion 21, which in the construction shown, has a stepped lower external configuration so as to include a lower flat surface mounting portion 21*a* with integral outward extending support flanges 21*b* on opposite sides thereof, and an upper flat machined surface 21*c*, with reference to this Figure. Flanges 21*b* are each provided with spaced apart apertures 21*d*.

Also with reference to FIG. 2, the body portion 21 is provided with a stepped vertical bore defining an internal upper wall 22, an intermediate wall 23 and a lower wall 24, with the upper wall 22 and lower wall 24 each having internal diameters greater than that of intermediate wall 23. Upper wall 22 is connected to intermediate wall 23 by a flat shoulder 25 and intermediate wall 23 is connected to lower wall 24 by a flat shoulder 26.

The body portion 21 is also provided with a stepped horizontal bore defining an internal outboard wall 30, a seal wall 32, an intermediate wall 31 and an inboard wall 33 that opens into the intermediate wall 23. The internal diameters of the outboard wall 30, seal wall 32 and intermediate wall 31 are preselected, as desired, so as to receive an electromagnetic fuel injector 34, with an O-ring seal 35 sealingly sandwiched between the seal wall 32 and the outer peripheral surface of the spray tip end 34*a* of the electromagnetic fuel injector 34. Another O-ring seal 35*a* is located in an annular groove provided for this purpose to sealingly engage the outboard wall 30.

Each electromagnetic fuel injector 34 is suitably axially retained in the body portion 21 as by a spring clip 16, in the construction shown, the spring clip 16 being secured as by at least one screw 17 threaded into the outer wall of the body portion 21. Preferably the inward spring leg 16*a* of the spring clip 16 is of C-shaped, when viewed from an end of the spring clip 16, so as to provide a substantially uniform bias against the electromagnetic fuel injector 34 in one axial direction, to the right with reference to FIG. 2.

Although the electromagnetic fuel injector 34 can be of any suitable type injector with either top feed or bottom feed, in the construction shown, the electromagnetic fuel injector 34 is a commercially available bottom feed injector that is similar in construction to the electromagnetic fuel injector disclosed in U.S. Pat. No. 4,423,842 issued Jan. 3, 1984 to James D. Palma, the disclosure of which is incorporated herein by reference thereto. Accordingly, the body portion 21 is provided with an internally threaded side port 37 opening through outboard wall 30 at a location so as to be in flow communication with the feed portion of the electromagnetic fuel injector 34 that is the portion thereof encircled by the annular fuel filter assembly 36. Side port 37 is adapted to be connected to a source of fuel, not shown, which is adapted to supply fuel at a suitable predetermined supply pressure to be described hereinafter.

As conventional, the solenoid coil, not shown, of each of the electromagnetic fuel injectors 34, for the respective cylinders of an engine, is adapted to be connected to a source of electrical power as controlled by an electronic control unit, such as an onboard computer, not shown, in a manner well known in the fuel injection art, the arrangement being such that when the solenoid coil, not shown, is energized, fuel will be discharged from its spray tip end 34*a* through the passage defined by inboard wall 33 into a cavity defined in part by the wall 23.

An injector nozzle body, hereinafter referred to as nozzle body 40, is of stepped external configuration defining an upper portion 40*a* of an external diameter so as to be received in the lower wall 24 of the body portion 21 and a lower reduced diameter portion 40*b* sized so as to be received in an associate through socket 3*a* provided in the cylinder head 3. As should be apparent to those skilled in the art, the lower reduced diameter portion 40*b* can be of any desired axial extent for a given engine application as evidenced by the difference in the axial extent of the portions 40*b* of the pneumatic injectors 20 shown in the engine applications shown in FIGS. 1 and 3.

At its upper end, the nozzle body 40 is provided with an annular groove 40*c* to receive an O-ring seal 41. The outer peripheral surface of the upper wall portion 40*a* is provided with an annular groove 40*d*, the upper wall of which is inclined to serve as a cam ramp which is engaged by the rounded head of an adjusting screw 42 threaded into an internally threaded aperture in the body portion 21 formed at right angles to the lower wall 24, whereby the nozzle body 40 can be moved and held to effect sealing engagement of the O-ring seal 41.

The injection nozzle body is provided with a stepped bore therethrough that defines an internal upper wall 44 concentric with and of the same diameter of intermediate wall 23 so as to, in effect, form an extension thereof, a valve stem guide wall 45 and a lower outwardly flared wall defining an annular, frusto conical valve seat 46 at the discharge end of the injection nozzle body 40. As best seen in FIG. 2, the inner peripheral surface of the valve stem guide wall 45 is provided with a plurality of circumferentially spaced apart radially outward extending axial grooves 47.

Flow through the nozzle body 40 is controlled by a poppet valve 50 having a head 50*a* with a seating surface conforming to the valve seat 46, a valve stem guide portion 50*b* slidably received in the valve stem guide wall 45 and a reduced diameter valve stem 50*c* of a suitable axial extent, relative to the axial extent of the preselected extent of the reduced diameter portion 40*b* of the nozzle body 40 and of the body portion 21, so that its upper externally threaded end 50*d* extends outboard of the body portion 21.

The poppet valve 50 is normally biased to a valve closed position, as shown, by a valve spring 51 loosely encircling the valve stem portions 50*c* and 50*d*, with one end thereof abutting against the flat shoulder 25 and its opposite end being in abutment against a centrally apertured, inverted cup shaped spring retainer 52 which in turn abuts against a nut 53 adjustably threaded on the valve stem end 50*d*, the latter at its free end having a screwdriver slot therein. As best seen in the enlarged FIG. 2, the side, outer peripheral wall of the spring retainer 52 is preferably provided with a plurality of circumferentially spaced apart apertures 52*a* for the passage of air in the event that, during adjustment of the bias force of the spring 51, the lower end surface of the spring retainer 52 and the surface 21*c* of the body portion 21 do not provide sufficient clearance therebetween for the free flow of air.

It should now be apparent that the clearance between the internal peripheral walls 23 and 44 of the body portion 21 and nozzle body 40, respectively, and the reduced diameter stem portion 50*c* of the poppet valve 50 define an air passage 54, into which fuel can be discharged by the associate electromagnetic fuel injector 34.

In the preferred embodiment and in the construction shown, air is supplied to the pneumatic injector 20 via a flanged, hollow, air inlet, cap 55 that is fixed to the body portion 21 by circumferentially spaced apart screws 56 that extend through apertures 55*b* provided in the flange 55*a* of the cap 55 for threaded engagement in internally threaded apertures 21*e* provided for this purpose in the body portion 21. As shown, the air inlet, cap 55 at its upper end is provided with an upstanding air hose connector 55*c* having a passage 55*d* therethrough that opens at one end into the cavity 57 in the cap 55 and which at its opposite end is connected to a source of pressurized air as supplied, for example, by an electric motor driven or engine driven air pump, not shown.

As shown, the air inlet cap 55 is sealed relative to the flat machined surface 21*c* of the body portion 21 by an O-ring seal 58, which in the construction shown, is positioned in an annular groove 55*e* provided for this purpose in the lower surface of the air inlet cap 55.

Figure 3:
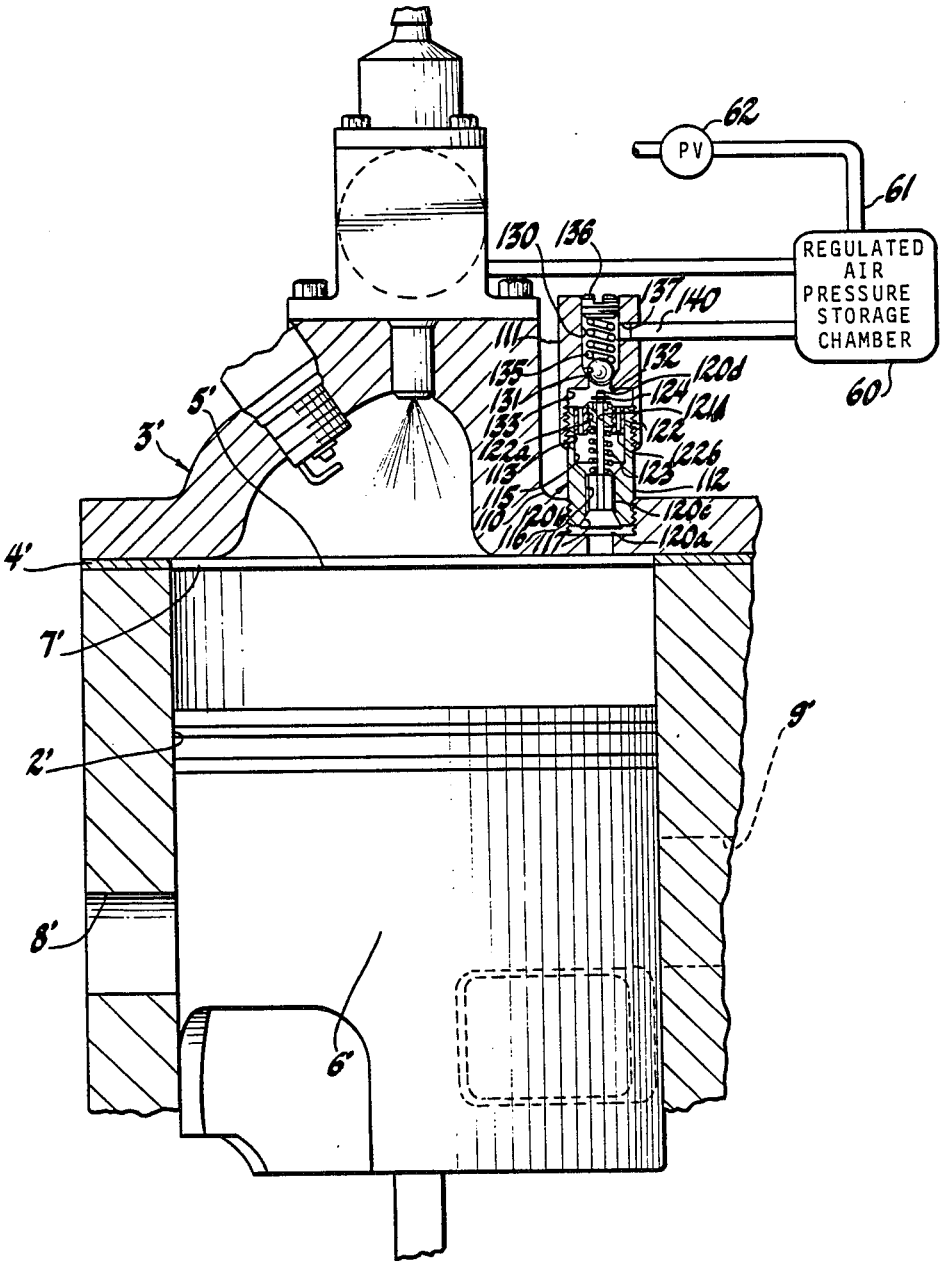

Preferably such an air pump, not shown, would, as shown in FIGS. 1 or 3, supply air to a regulated air pressure storage chamber 60. An air pressure relief passage 61 having a conventional pressure regulator 62 associated therewith is operatively connected at one end to the regulated air pressure storage chamber 60 and at its opposite end would be connected for flow communication with the air induction passage, not shown, preferably downstream of the throttle valve, not shown.

Now with respect to a four stroke, multiple cylinder engine of the type shown in FIG. 1, the pressurized air from the regulated air pressure storage chamber 60 is preferably supplied to each set of associate first and second cylinders by a solenoid 63 controlled air passage rail means. That is, assuming that cylinder 2 of FIG. 1 is the first cylinder, its associate second cylinder would be a cylinder in which its piston 6 would be on an exhaust stroke when the piston 6 of the associate first cylinder 2 in FIG. 1 is on a compression stroke, and then, of course when the latter piston 6 is on an exhaust stroke, the piston in the associate second cylinder would be on a compression stroke.

With this arrangement, as the piston 6 in the first cylinder 2 of FIG. 1 is at the beginning or shortly thereafter of a compression stroke, the solenoid coil, not shown of the electromagnetic fuel injector 34 would be energized by a source of electrical power as controlled by the electronic control unit, previously referred to hereinabove, so as to supply fuel to this first cylinder 2, in a manner to be described, whereas the solenoid coil of the electromagnetic fuel injector in the pneumatic injector for the associate second cylinder would not be energized so that only air is delivered to this associate second cylinder as its piston is moving on its exhaust stroke to help in the purging of exhaust gases from the latter cylinder.

FUNCTIONAL DESCRIPTION

With the preferred air supply arrangement shown, during four cycle engine operation, air would be supplied to the pneumatic injector at a suitable supply pressure such that when the associate piston 6 is near the end of a suction stroke or at the start of a compression stroke, the differential pressure of the air acting on the poppet valve 50 would be such as to effect opening movement thereof to a valve open position with respect to its associate valve seat 46. This allows for the delivery of air to the stratified charge chamber 5 and thus to the combustion chamber 7.

Now, when the poppet valve 50 is in the valve open position, the solenoid coil, not shown, of the electromagnetic fuel injector 34, which is supplied with fuel at a predetermined higher pressure than that of the air being supplied, is energized, so that fuel will be discharged into the air passage 54 for delivery with the pressurized air therein to the stratified charge chamber 5 via the discharge passage that then exists between the head 50*a* of the poppet valve 55 and the associate valve seat 46. This cross-sectional flow area is made small enough to restrict the quantity of air delivered by the pneumatic injector 20 so that it is only a small percentage of the total air induction charge to the combustion chamber whereby to reduce secondary air usage and to thus minimize its effect on the overall air-fuel ratio.

Thereafter, as the piston 6 continues on its compression stroke, the cylinder compression pressure will then reach a value so that the pressure differential across the poppet valve 50, with the aid of spring 51, will be such so as to again move the head 50*a* of the poppet valve 50 into seating engagement with the valve seat 46.

By way of an example, in a particular engine application, the air was supplied to the pneumatic injector at a pressure of 550 kPa (about 80 psi) and the fuel was supplied to the electromagnetic fuel injector 34 at a pressure of 650 kPa (about 94 psi). Thus the differential pressure between that of the air and fuel was 100 kPa (14.5 psi). In this application, the air volume in the air passage rail means and within the pneumatic injector 20 was relatively large so as to minimize the pressure effect of injecting preselected air volumes into the air passage 54.

An alternate embodiment of a pneumatic direct cylinder fuel injection system in accordance with the invention as used on a multi cylinder, two stroke engine is shown in FIG. 3 wherein similar parts are designated by similar numerals but with the addition of a prime (′) where appropriate.

Referring now to FIG. 3 there is shown a portion of a multiple cylinder, two stroke, internal combustion engine having an engine block means, which includes an engine block 1' with bores therein defining cylinders 2', only one being shown, and a cylinder head 3' fixed in a conventional manner to the engine block 1', with the usual gasket 4' sandwiched therebetween.

The cylinder head 3', at each cylinder bore 2' location, is provided with a recessed cavity defining a stratified charge chamber 5' which defines with a piston 6' reciprocable in the cylinder bore 2 a combustion chamber 7'.

In the construction shown, the two-stroke engine is of the type having an intake port 8' and an exhaust port 9' provided at suitable locations in the engine block 1, each of which opens through the cylinder bores 2' whereby they can be uncovered or covered, as shown, by the piston 6' as well known in the art.

As shown, a pneumatic injector 20, in accordance with the preferred embodiment illustrated in FIGS. 1 and 2, is suitably mounted on the cylinder head 3' with its nozzle body 40 extending through a socket 3a' into the stratified charge chamber 5' portion of an associate combustion chamber 7'. Preferably in a two-stroke engine, each of the pneumatic injectors 20 associated with an associate cylinder is continually in flow communication with a source of pressurized air maintained at a predetermined supply pressure.

In the type of two-stroke engine shown in FIG. 3, as the piston 6' moves down, from the position shown, in its power stroke, it first uncovers the exhaust port 9' to allow burned gases to escape and then it uncovers the intake port 8' to allow a new charge of air, as from the crankcase, not shown, to enter the combustion chamber 7'. Then, on the upward stroke, the piston 6' covers the intake port 8' and then the exhaust port 9' and, then it begins to compress the new charge of air.

Now in accordance with another feature of the invention, the source of pressurized air required to effect the operation of the pneumatic injectors 20 is obtained from the combustion chamber 7', during the upward compression stroke of a pston 6' in its associate cylinder bore 2, with flow of compressed air from each combustion chamber 7' to the regulated air pressure storage chamber 60 being controlled by an air source control valve.

In the construction shown, the air source control valve includes a lower housing 110 and an upper housing 111 secured together by threaded engagement of the external threads at the upper end of the lower housing 110 with the internal threads 113 of the upper housing 111. In addition, the lower end of the lower housing 110 is formed with complementary external threads to threadingly engage the threaded bore in the cylinder head 3'.

The lower housing 110 is provided with a stepped through bore defining an enlarged internal upper wall 115, a valve stem guide wall 116 and an outwardly flared frusto conical valve seat wall 117. A normally open, over pressure shut off valve in the form of a poppet valve is operatively mounted in the lower housing 110. In the construction shown, the poppet valve 120 has a head 120a with a valve seating surface formed complementary to the valve seat wall 117, a valve stem guide portion 120b with flats 120c thereon slidably received and guided by the valve stem guide wall 116, and an elongated valve stem 120d of reduced external diameter, the latter extending loosely through the central aperture in a spring adjusting screw 121d.

The spring adjusting screw 121d is adjustably threaded into the internally threaded bore 122a of a disk like retainer 122 suitably secured, as by a press fit in the upper wall 115 of the lower housing. The retainer 122, radially outward of its threaded bore 122a is provided with a plurality of circumferentially spaced apart axial extending air flow passages 122b. A valve spring 123 is positioned to loosely encircle the valve stem 120d with one end thereof in abutment against the spring adjusting screw 121d and its other end in abutment against the valve stem guide portion 120b so as to normally bias the poppet valve toward a valve open position with a predetermined force. Axial movement of the poppet valve in a valve opening direction is limited by a retainer ring 124 engaged in a groove provided for this purpose adjacent to the upper free end of the valve stem 120d.

The upper housing 111 is provided with a stepped through bore defining an upper internally threaded wall 130, an inwardly tapered wall defining a frusto conical valve seat 131 which connects by a straight wall passage 132 to an enlarged diameter lower wall 133 which is threaded as at 113.

Flow through the passage 132 is controlled by a suitable one-way check valve, such as ball valve which is normally biased by a spring 135 of a predetermined force, as desired, to a valve closed position, as shown in FIG. 3. The preload force of the spring 135 can be adjusted by an internal wrenching head screw 136 adjustably threaded into the upper threaded wall 130 of the upper housing 111.

In the construction shown, each air source control valve is connected in flow communication with the regulated air pressure storage chamber 60 as by a conduit 140 threaded into an internally threaded side port 137 provided in the upper housing 111 so as to break through the upper wall 130.

Functional Operation of the Air Source Control Valve

During engine operation, when a piston 6' is in the initial stage of a compression stroke, the pressure in the combustion chamber 7' is insufficient to overcome the force of the spring 135 on the check valve or valve ball and the air pressure force on the upstream side of this ball. As the pressure increases on the compression stroke, the valve ball 134 will open so that pressurized air will be delivered to the regulated air pressure storage chamber 60. When the pressure in the combustion chamber 7' becomes sufficiently high, as predetermined, the pressure imbalance or pressure differential between the combustion chamber 7' side of the poppet valve and the top side of the poppet valve will effect closure of the poppet valve against the valve seat 117.

As a system, the air source control valves should be sized to always supply slightly more air than that actually flowing through the pneumatic injectors 20. This allows the pressure regulator valve 62 to always function during each compression stroke of the respective pistons 6' in the cylinders of the engine.

Of course, during each compression stroke of a piston 6' the associate pneumatic injector 20, as previously described, will supply an air/fuel mixture into the associate stratified charge chamber 5' In theory, it can be assumed that this air/fuel mixture will be trapped in the stratified charge chamber 5' by the charge of air being compressed by the piston 6' as it continues on its compression stroke.

However, if some of this air/fuel mixture or a diluted quantity thereof does flow through the air source control valve into the regulated air pressure storage chamber 60, either the pressure regulator valve 62 controlled passage 61 will deliver such a diluted air/fuel mixture to the induction passage, not shown, of the engine on the downstream side of the usual throttle valve, not shown, or this mixture will be delivered to the pneumatic injectors 20 for return to the combustion chambers 7' of the engine.

Referring now again to the pneumatic injectors 20, although the pressure values for the air and fuel were given for specific engine applications, it should now be apparent to those skilled in the art that the fuel pressure is always referenced to air pressure so that the pressure drop on the fuel during its discharge from an electromagnetic fuel injector 34 is preferably approximately 100 kPa (14.5 psi). Thus if air pressure is changed from the example described, the fuel pressure should be changed accordingly.

By the use of the subject pneumatic fuel injection system, it should now be apparent that the pneumatic injectors are operative to discharge the fuel in very small droplets into the associate stratified charge chambers where this air/fuel mixture is substantially concentrated for easy ignition, even under cold start conditions or during transient conditions. With respect to its use in a two-cycle engine, it should now be apparent that since the air/fuel mixture is not injected until after the piston has closed the associate exhaust port there will be no loss of fuel out through the exhaust system of the engine.

While the invention has been described with reference to the structures disclosed herein, it is not confined to the specific details set forth, since it is apparent that many modifications and changes can be made by those skilled in the art. This application is therefore intended to cover such modifications or changes as may come within the purposes of the improvements or scope of the following claims.

The embodiments of the invention in which an exclusive property or privilege is claimed are defined as follows:

1. A pneumatic direct cylinder fuel injection system for use in an internal combustion engine of the type having an engine block means with an air induction means for supplying induction air to a plurality of cylinders in the engine block means, with each cylinder having a piston reciprocable therein so as to define a combustion chamber which includes a stratified charge chamber as a portion thereof, said system including a plurality of pneumatic injectors, with each said pneumatic injector being supported by the engine block means in position to discharge an air/fuel mixture into an associate stratified charge chamber, each of said pneumatic injectors including a body means terminating at one end thereof in a nozzle body, a bore means through said body means and said nozzle body, a valve seat encircling said bore means at the outboard free end of said nozzle body, the opposite end of said bore means being connectable to a source of air at a predetermined pressure, a poppet valve operatively positioned in said bore means, said poppet valve including a head movable between an open position and closed position relative to said valve seat and a stem extending from said head and defining with said bore means an air passage, control means operatively associated with said poppet valve to normally maintain said poppet valve in said closed position and being operative to permit movement of said poppet valve to said open position and, an electromagnetic fuel injector operatively positioned in said body means for injecting pressurized fuel into said air passage upstream of said head of said poppet valve in terms of the direction of air flow through said air passage during a compression stroke of the piston in the associate cylinder, the arrangement being such that when the compression pressure reaches a predetermined pressure said poppet valve will be moved to a said valve closed position.

2. A pneumatic direct cylinder fuel injection system according to claim 1 wherein said control means of a said pneumatic injector is a spring means of a predetermined bias operatively connected to said poppet valve so that the differential pressure acting on said poppet valve will effect movement of said poppet valve between said open position and said closed position as a function of the axial direction of said differential pressure.

3. A pneumatic direct cylinder fuel injection system according to claim 2, wherein said source of pressurized air is the engine and includes a plurality of source control valves, each of said source control valves being operatively associated in flow communication with an associate combustion chamber in a said cylinder, each said source control valve including a housing means having a passage means with one end thereof in flow communication with an associate combustion chamber, a normally open, spring biased, pressure actuated poppet valve controlling flow from said combustion chamber through said passage, a normally closed, one-way, spring biased valve positioned in said passage means upstream of said poppet valve in terms of the direction of air flow, a regulated air pressure storage chamber connected in flow communication with the opposite end of said passage means, a passage means having one end in flow communication with said regulated air pressure storage chamber and its opposite end in flow communication with said air passages in said pneumatic injectors and, a pressure regulated passage means connected at one end to said regulated air pressure storage chamber and at its opposite end to the air induction means of the engine.

4. A pneumatic direct cylinder fuel injection system according to claim 1, wherein said source of pressurized air is the engine and includes a plurality of source control valves, each of said source control valves being operatively associated in flow communication with an associate combustion chamber in a said cylinder, each said source control valve including a housing means having a passage means with one end thereof in flow communication with an associate combustion chamber, a normally open, spring biased, pressure actuated poppet valve controlling flow from said combustion chamber through said passage, a normally closed, one-way, spring biased valve positioned in said passage means upstream of said poppet valve in terms of the direction of air flow, a regulated air pressure storage chamber connected in flow communication with the opposite end of said passage means, a passage means having one end in flow communication with said regulated air pressure storage chamber and its opposite end in flow communication with said air passages in said pneumatic injectors and, a pressure regulated passage means connected at one end to said regulated air pressure storage chamber and at its opposite end to the air induction means of the engine.

* * * * *